United States Patent [19]

Frahm et al.

[11] 4,062,384

[45] Dec. 13, 1977

[54] VAPOR RECOVERY ADAPTER FOR GASOLINE-DISPENSING NOZZLES

[75] Inventors: Bradley K. Frahm, Stockton; William E. Watson, Fair Oaks, both of Calif.

[73] Assignee: Ames Company, Sacramento, Calif.

[21] Appl. No.: 702,014

[22] Filed: July 2, 1976

[51] Int. Cl.[2] ..... B65B 31/06

[52] U.S. Cl. ..... 141/46; 137/202; 141/95; 141/290; 141/302

[58] Field of Search ..... 137/202; 141/42, 46, 141/52, 59, 95, 96, 198, 206–229, 285, 290, 302, 303, 392

[56] References Cited

U.S. PATENT DOCUMENTS

| | | | |
|---|---|---|---|
| 3,581,782 | 6/1971 | Onufer | 141/52 X |
| 3,782,427 | 1/1974 | Zeimet et al. | 141/46 X |
| 3,866,636 | 2/1975 | Lasater | 141/59 |
| 3,899,009 | 8/1975 | Taylor | 141/59 |
| 3,958,591 | 5/1976 | Hansel et al. | 137/202 |
| 4,023,601 | 5/1977 | Hansel | 141/207 |

*Primary Examiner*—Richard E. Aegerter
*Assistant Examiner*—Frederick R. Schmidt
*Attorney, Agent, or Firm*—Roger B. Webster

[57] ABSTRACT

The disclosure is of a gasoline-dispensing nozzle converted, by an adapter, from a conventional configuration to a vapor recovery type.

5 Claims, 7 Drawing Figures

VAPOR RECOVERY ADAPTER FOR GASOLINE-DISPENSING NOZZLES

BACKGROUND OF THE INVENTION

1. Field of the Invention

Gasoline-dispensing, vapor recovery nozzles have heretofore been developed in sundry types; such nozzles—which include a member to seal with the filler neck of the vehicle's fuel tank—functioning to capture and return displaced fuel vapor, through a return hose, to the main fuel storage tank from which the fuel is dispensed. These prior gasoline-dispensing, vapor recovery nozzles are, however, subject to the objection that—upon the fuel tank of the vehicle being completely filled, and with the filler neck closed by the sealing members—it was possible for a careless or unscrupulous operator to continue the fuel delivery—this resulting in a quantity of fuel overflowing such tank and, through the vapor return hose, flowing back to the main fuel storage tank, at an overcharge to the customer. The present invention was conceived in a successful effort to overcome such problem.

2. The Prior Art

U.S. Pat. Nos. 2,908,299; 3,830,267; 3,840,055 and 3,866,636 are representative of the prior art known to applicants.

SUMMARY OF THE INVENTION

The present invention provides, as a major object, a novel adapter whereby a conventional gasoline-dispensing nozzle can be readily and conveniently converted from a conventional configuration to a law-required, vapor recovery type, thus obviating the necessity of replacement of existing nozzles and hence effecting a substantial economy.

The present invention provides, as another important object, an improved adapter, for conversion of a conventional gasoline-dispensing nozzle to a vapor recovery type, which includes fail-safe instrumentalites which automatically prevent any fuel from entering the vapor returen hose and flowing back to the main fuel storage tank upon the fuel tank of the vechicle being completely filled and then overflowing into such return hose. Such instrumentalities include a safety by-pass valve which not only causes any such overflow to spill from the nozzle, but, additionally, prevents any pressure damage to the vehicle's fuel tank which might otherwise occur due to nozzle malfunction, obstructed vapor return line, or otherwise.

The present invention provides, as still another important object, an adapter—for the purpose described—which includes a simple but effective means for attachment of said adapter to a conventional gasoline-dispensing nozzle; the adapter also including a novel arrangement for effecting—during fuel dispensing—the law-required seal with the filler neck of a vehicle's fuel tank.

The present invention provides, as a further object, a practical, reliable, and durable vapor recovery adapter for gasoline-dispensing nozzles, and one which is exceedingly effective for the purpose for which it is designed.

DESCRIPTION OF THE PREFERRED EMBODIMENT

Figure 1:
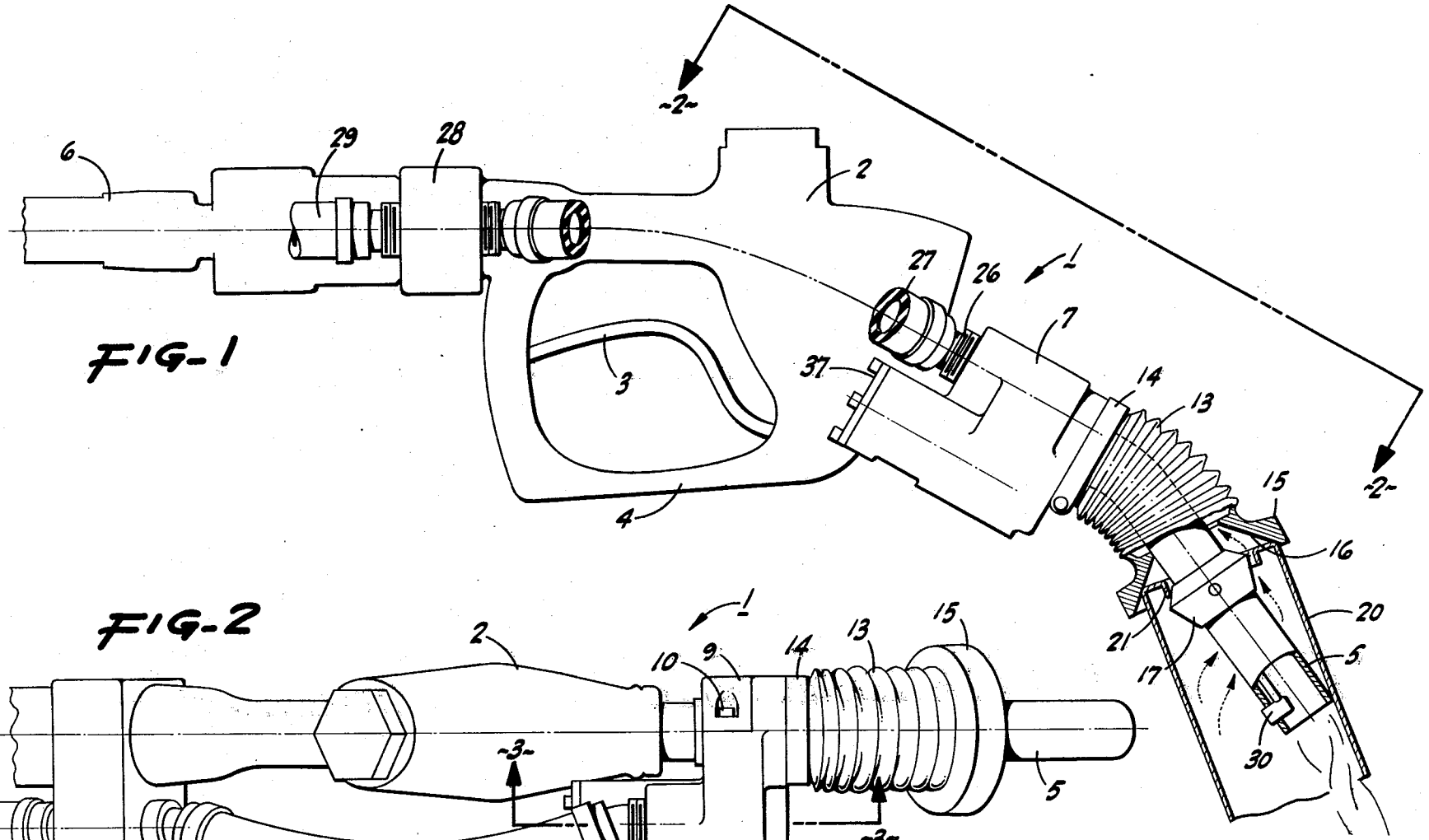
FIG. 1 is a side elevation of a conventional gasoline-dispensing nozzle with the vapor recovery adapter mounted thereon.
Figure 2:
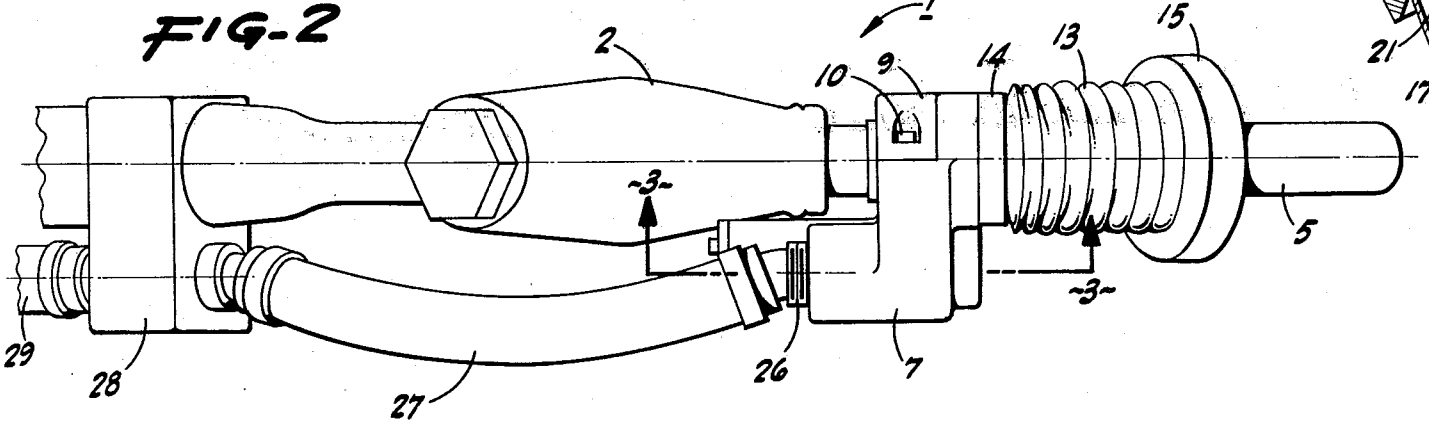
FIG. 2 is a top plan, taken substantially on line 2—2 of FIG. 1, of the same.
Figures 3, 4, 5, 6, 7:
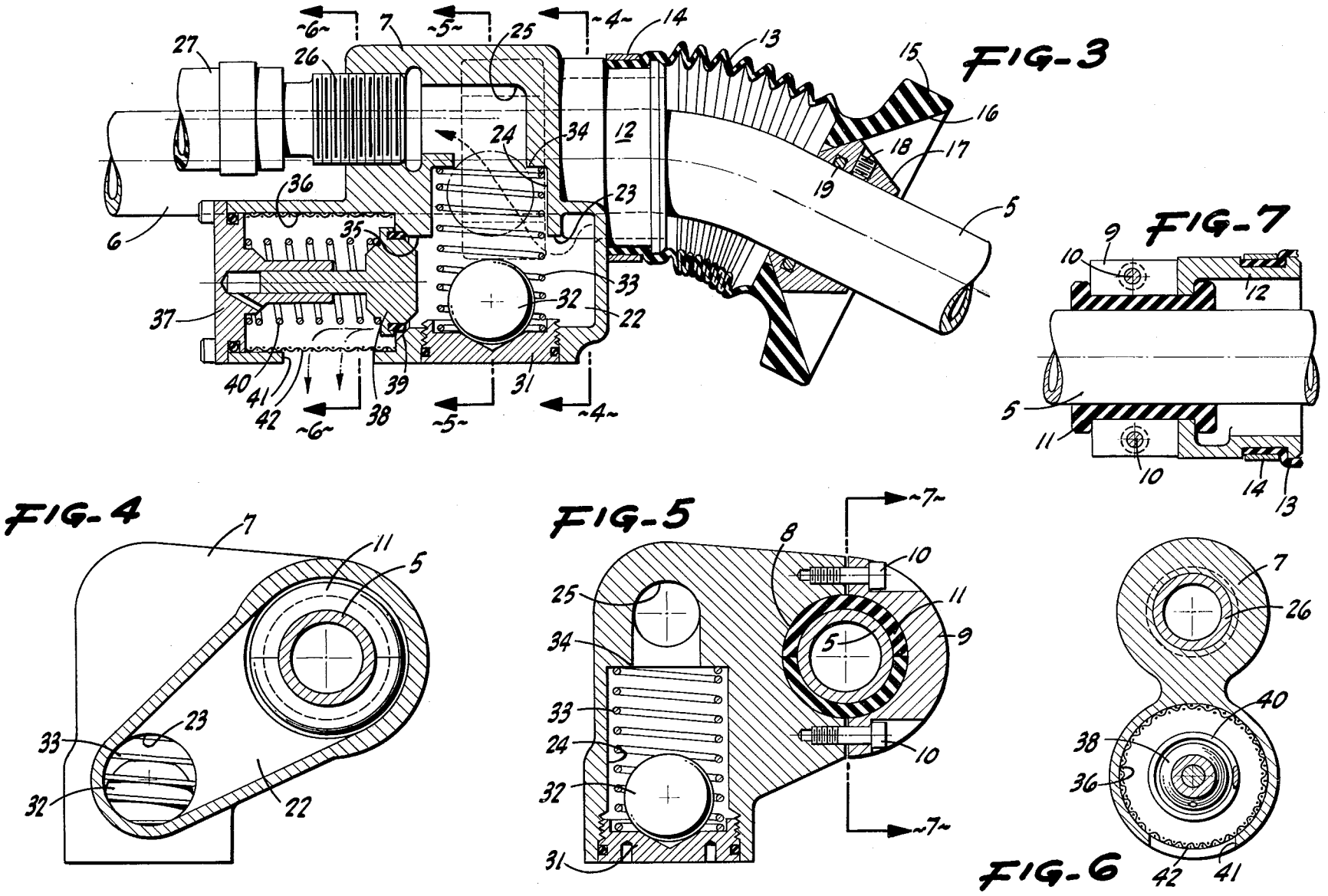
FIG. 3 is an enlarged, fragmentary sectional elevation taken substantially on line 3—3 of FIG. 2.
FIGS. 4, 5, and 6 are cross sections taken substantially on lines 4, 5, and 6, respectively, of FIG. 3.
FIG. 7 is a fragmentary sectional elevation taken substantially on line 7—7 of FIG. 5.

Referring now more particularly to the drawings and to the characters of reference marked thereon, the vapor recovery adapter of the present invention mounts on a conventional gasoline-dispensing nozzle, indicated generally at 1, which includes a body 2 having a flow-control lever 3 within a guard 4; there being a fuel delivery spout 5 projecting from the front end of the body 2, while the fuel supply hose 6 is connected to the rear end of said body.

The adapter, of the present invention, comprises a housing 7 which is mounted on the spout 5 adjacent the body 2 of the nozzle; such housing 7 having a longitudinal bore 8 through which the spout extends. To permit installation of the housing 7 on the spout 5, such housing includes an initially separate clamping segment 9 which spans half the bore 8 and bolts, as at 10, in clamping relation to the portion of the housing formed with the other circumferential half of such bore. A bushing 11 on the spout 5 provides a holding element and seal between the spout and the clamped-in-place portion of said housing.

The housing 7, as so mounted on the spout 5, includes an integral, forwardly projecting, annular projection 12 which surrounds the spout 5 in clearance relation and serves for attachment of the rear end of an axially resilient, corrugated or accordion neck 13; the rear end of neck 13 being secured to projection 12 by a clamp 14.

The accordion neck 13, of substantially greater inside diameter than the outside diameter of the spout 5, is fitted at the front end with a closure cup 15—of relatively soft rubber or the like—having an inwardly tapering, frustoconical mouth 16 opening into such neck.

A collar 17 is secured, by set screw 18, on the spout 5 ahead of the closure cup 15 and includes, internally, an O-ring 19 which seals with the spout; such collar 17, which has opposed bevel faces, serving initially as a stop to limit forward advance of the closure cup 15 by the axially resilient accordion neck 13.

When the nozzle 1 is in use with the front end portion of the spout 5 extending into the fuel filler neck 20 of a vehicle's fuel tank, the collar 17 engages—as shown in FIG. 1—under the inturned lip 21 at the entry end of such neck 20. Thus, such collar 17 serves, during a fuel-dispensing operation, to prevent accidental escape of the spout 5 from neck 20.

When—for a fuel-dispensing operation—the spout 5 is projected into the filler neck 5 and located in position by the collar 17, the closure cup 15 engages the entry end of said filler neck, and said end is received in sealed relation in the tapered mouth 16 of such cup; the closure cup 15 then being pushed back from the locating collar 17 whereby the accordion neck 13 is under axial compression and which assures that the mouth 16 seals with filler neck 20.

Thereafter, with delivery of fuel from spout 5 into the vehicle's fuel tank, fuel vapor is—by displacement—caused to flow upwardly in filler neck 20 and thence into the accordion neck 13; this without escape to the atmosphere, and which is prevented by closure cup 15 as sealed with said filler neck 20.

From the accordion neck 13, the vapor is conducted through the housing 7 as follows:

The vapor flows from neck 13 into a transverse internal chamber 22 which extends at a downward incline relative to the related part of spout 5; there being a port 23 which opens between the lower portion of chamber 22 and a vertical bore 24 in housing 7 clear of bore 8. The vapor transfers—through port 23—from chamber 22 into bore 24, and—from the upper end of the latter—flows into a connected passage 25 of dog-leg or inverted "L" configuration.

The passage 25 opens to the rear of housing 7, and—by means of a fitting 26—a short, longitudinal hose 27 is connected in communication with said passage 25; such hose 27 extending rearwardly to a nozzle-mounted coupling block 28 which provides a connection of the short hose 27 with a vapor return hose 29 which vents—as now required by law—to the main fuel storage tank. The short, longitudinal hose 27 is bowed outwardly, as shown, in order to permit, without obstruction, ready manual grasping of the nozzle 1, and finger engagement of lever 3, by the operator.

While the vapor return hose 29 is mentioned in this specification as venting to the main fuel storage tank, it is, of course, to be understood that in practice said hose 29 actually connects to underground piping (not shown) which leads back to said tank.

When the nozzle, as herein described as adapted for vapor recovery, is in normal use, such nozzle automatically shuts off and gasoline dispensing ceases when the vehicle's fuel tank is full; the automatic shut-off mechanism of the nozzle being conventional and including a fuel sensor head 30 in the front end portion of spout 5.

However, in the event of malfunction of the automatic shut-off mechanism of the nozzle, or so-called "continuous topping" by an unscrupulous operator, the fuel continues to deliver and overflows the vehicle's fuel tank as the filler neck is end-sealed, and—in the absence of preventive means—the overflowing fuel returns through the vapor recovery system to the main fuel storage tank. To prevent such an occurrence, the adapter, of the present invention, provides a novel valve arrangement to prevent liquid fuel from flowing from the nozzle into the vapor recovery hose; such valve arrangement comprising the following:

The vertical, cylindrical bore 24 is closed at its lower end by a sealed plug 31 which normally provides a rest for a ball-type float valve 32; the valve 32 being within the confines of an open-loop helical cage 33 disposed in and extending the full height of bore 24. If liquid fuel overflows the vehicle's fuel tank and gains access to the adapter, such overflowing fuel—after passing through accordion neck 13, chamber 22, and port 23—enters and fills bore 24, whereupon the ball-type valve 32 floats to the upper end of said bore and engages or closes with an annular seat 34. When this occurs, the overflowing fuel is effectively prevented from entering passage 25 and the vapor return hose 29.

Also, when the fuel overflows from the vehicle's fuel tank into the adapter, as above described, such overflow is spilled from the adapter—as a signal or warning of the overflow condition—in the following manner:

A port 35, opposite the port 23, provides communication between the bore 24 and a substantially horizontal or longitudinal bore 36 closed at the outer or rear end by a sealed plug 37; the port 35 normally being closed by a guidedstem type valve 38 yieldably urged in the direction of port 35 and against a valve seat 39 formed with such port 35. A spring 40 yieldably urges valve 35 into closing relation with the seat 39.

When fuel overflows the vehicle's fuel tank and enters—under pressure—the bore 24, the float valve 32 first closes against seat 34, and then the pressure of the fuel in said bore 24 causes valve 38 to yield away from seat 39, whereupon the overflow fuel escapes into bore 36 and thence spills from a lower-side port 41 opening from said bore 36. A cylindrical screen 42, in bore 36, prevents entry into the latter of insects or debris. Such spill signals to the operator, or to the customer, the overflow condition.

With a conventional gasoline-dispensing nozzle fitted with the herein described adapter, effective fuel vapor recovery is attained and yet without the possibility of over-flow fuel—at an overcharge to the customer—being improperly returned to the main fuel supply tank.

From the foregoing description, it will be readily seen that there has been produced such a vapor recovery adapter for gasoline-dispensing nozzles as substantially fulfills the objects of the invention as set forth herein.

While this specification sets forth in detail the present and preferred construction of the vapor recovery adapter for gasoline-dispensing nozzles, still in practice such deviations from such detail may be resorted to as do not form a departure from the spirit of the invention as defined by the appended claims.

What is claimed is:

1. A vapor recovery device comprising—in connection with a fuel-dispensing nozzle coupled to a fuel supply hose and associated with a vapor return hose, and having a forwardly projecting spout—a vapor-conducting neck freely surrounding a portion of the spout, the neck having a forwardly opening mouth adapted to seal with a fuel tank filler neck upon projection of the spout thereinto, a nozzle-supported housing having a vapor flow passage therethrough, means connecting the rear end of the vapor-conducting neck to said housing in communication with one end of such vapor flow passage, means to connect the opposite end of said passage in communication with the vapor return hose, and a check valve in the vapor flow passage, the check valve being normally open for vapor flow through said passage but automatically closing in response to liquid flow therein, such check valve being of floatable type including a ball, a ball-receiving seat in vapor flow passage, the ball normally being remote from the seat but floating into engagement there-with upon such liquid flow in said passage; there being a liquid fuel escape port in the housing, a separate passage leading from such escape port to said vapor flow passage at a point upstream relative to the check valve, a separate valve in the housing between said passages, and means normally but yieldably closing the separate valve; the check valve first closing, by the ball floating into engagement with the seat, in response to liquid fuel flow in the vapor flow passage, and said separate valve the sequentially opening in response to said liquid fuel flow in said vapor flow passage and attendant closing of the check valve, whereupon the liquid fuel flow spills from such escape port.

2. A vapor recovery device, as in claim 1, including a protective screen covering such liquid fuel escape port.

3. A vapor recovery device comprising—in connection with a fuel-dispensing nozzle coupled to a fuel supply hose and associated with a vapor return hose, and having a forwardly projecting spout—a vapor-conducting neck freely surrounding a portion of the spout, the neck having a forwardly opening mouth adapted to seal with a fuel tank filler neck upon projection of the spout thereinto, a nozzle-supported housing having a vapor flow passage therethrough, means connecting the rear end of the vapor-conducting neck to said housing in communication with one end of such vapor flow passage, means to connect the opposite end of said passage in communication with the vapor return hose, and a check valve in such passage, the check valve being normally open for vapor flow through said passage but automatically closing in response to liquid fuel flow therein; there being instrumentalities in said housing, operative in response to closing of the check valve, to spill such liquid fuel flow from the nozzle; said instrumentalities including a liquid fuel escape port, a separate passage leading from such escape port to said vapor flow passage at a point upstream relative to the check valve, a separate valve in the housing between said passages, and means normally but yieldably closing said separate valve, the latter sequentially opening in response to liquid fuel pressure in the vapor flow passage upstream from, and attendant closing of, the check valve.

4. A vapor recovery device comprising—in connection with a fuel-dispensing nozzle coupled to a fuel supply hose and associated with a vapor return hose, and having a forwardly projecting spout—a vapor-conducting neck freely surrounding a portion of the spout, the neck having a forwardly opening mouth adapted to seal with a fuel tank filler neck upon projection of the spout thereinto, a nozzle-supported housing having a vapor flow passage therethrough, means connecting the rear end of the vapor-conducting neck to said housing in communication with one end of such vapor flow passage, means to connect the opposite end of said passage in communication with the vapor return hose, and a check valve in such passage, the check valve being normally open for vapor flow through said passage but automatically closing in response to liquid fuel flow therein; the valve flow passage including a vertical bore in the housing, and the check valve comprising a floatable ball normally resting in the lower portion of said vertical bore, there being an annular ball-receiving seat in the upper portion of such vertical bore; the vapor flow being upwardly in the bore, and the ball floating upward into engagement with the seat upon liquid fuel filling the vertical bore; there being another bore in the housing, the housing having a liquid fuel escape port open to said other bore, the latter leading to the vertical bore at a point spaced below the check valve slot, a separate valve in said other bore, and means normally but yieldably closing the separate valve; the check valve first closing in response to liquid fuel flow in the vertical bore, and said separate valve then sequentially opening in response to liquid fuel flow in said vertical bore and attendant closing of the check valve, whereupon liquid fuel flows through said other bore and spills through said escape port.

5. A vapor recovery device comprising—in connection with a fuel-dispensing nozzle coupled to a fuel supply hose and associated with a vapor return hose, and having a forwardly projecting spout—a vapor-conducting neck freely surrounding a portion of the spout, the neck having a forwardly opening mouth adapted to seal with a fuel tank filler neck upon projection of the spout thereinto, a nozzle-supported housing having a vapor flow passage therethrough, means connecting the rear end of the vapor-conducting neck to said housing in communication with one end of such vapor flow passage, means to connect the opposite end of said passage in communication with the vapor return hose, and dual valves associated with the vapor flow passage; one valve being normally open but arranged to close and block said passage in response to liquid fuel flow therein, the housing having a liquid fuel escape port therein, a separate passage in the housing leading from such escape port to said vapor flow passage at a point upstream relative to said one valve, and the other valve being disposed between said passages and normally closed but arranged to open and establish communication therebetween and hence between the vapor flow passage and the escape port, in response to liquid flow in said vapor flow passage and attendant blockage thereof by said one valve.

* * * * *